United States Patent [19]

Landström

[11] 4,433,626

[45] Feb. 28, 1984

[54] UNDERWATER MISSILE FOR USE AGAINST SUBMERGED SUBMARINES

[76] Inventor: Sven Landström, Fjällgatan 16, Stockholm, Sweden, S-116 45

[21] Appl. No.: 310,999

[22] Filed: Oct. 13, 1981

[30] Foreign Application Priority Data

Oct. 13, 1980 [GB] United Kingdom ..... 8032962

[51] Int. Cl.[3] ..... F42B 21/00

[52] U.S. Cl. ..... 102/390; 102/417

[58] Field of Search ..... 102/390, 406, 417, 421, 102/422

[56] References Cited

U.S. PATENT DOCUMENTS 2,599,579 6/1952 Park et al. ..... 102/417
3,855,933 12/1974 Messineo .
3,995,574 12/1976 Drimmer .

FOREIGN PATENT DOCUMENTS 578771 7/1946 United Kingdom .

*Primary Examiner*—Charles T. Jordan
*Attorney, Agent, or Firm*—Holman & Stern

[57] ABSTRACT

An underwater missile for use against submerged submarines has a missile housing with a magnetic contact surface (2) at a foremost end portion intended to contact a submerged submarine. The magnetic contact surface is provided by two magnets (2',2'') located in adjacency and with reversed magnetic polarity. A magnetically operated switching means (5) is positioned adjacent to the magnetic leakage field of the magnets, and is arranged to be operated when the leakage field is increased by means of a metallic object located within the magnetic field of the magnets. The operation of the switching means first detonates a small propellant charge (6) to impose a force to cause complete adherence between the magnetic contact surface of the missile and the outer surface of a contacted submarine, and then detonates a main explosive charge (7) intended to penetrate the submarine.

9 Claims, 5 Drawing Figures

UNDERWATER MISSILE FOR USE AGAINST SUBMERGED SUBMARINES

BACKGROUND OF THE INVENTION

The present invention relates to an underwater missile to be used against submerged submarines.

It is previously known to use depth charges, launched from a ship or an aircraft, e.g. a helicopter, preset to explode when the charges reach a certain depth. However, such charges must be either very large or explode extremely close to a submarine to cause any damage, and if damage is caused, it is usually restricted only to the outer hull of the submarine, located at a distance from the inside hull and separated from same by means of water. In order to cause actual damage to the inside hull, the explosive energy should be directed towards the outer structure of the submarine, i.e. the charge should be of directed type, exploding at a predetermined distance from the outer structure of the submarine. Due to the convex cross-sectional configuration of a submarine, a missile including a directed explosive charge must be aligned extending transversely from the outside surface of the external structure of the submarine, having the charge located at a distance from said surface, in order to achieve the desired result. As a result, a direct hit would be required, and most missiles would only slide past the outside structure of the submarine, without causing any damage.

SUMMARY OF THE INVENTION

The object of the present invention is to provide an underwater missile, which can be launched from a ship or an aircraft, and which does not require a complete contact with the outside structure of a submerged submarine to take up a correctly aligned position to the outside surface with an explosive charge of directed type located at a predetermined distance from said durface, thereby faciliating penetration of both the outside and inside hull of the submarine.

According to one aspect of the invention, there is provided a missile to be launched by a ship or an aircraft, including a magnetic device at the foremost end portion of the missile intended to contact a submerged submarine, said magnetic device including two magnets having a co-acting magnetic field and a magnetically operated switching means. The magnetically operated switching means is arranged to change condition when the flux of the magnetic field is changed by a nearby metallic object having a mass exceeding a predetermined value, and when said switching means is operated, a small propellant charge in the missile is initiated, said charge being arranged to force the foremost end portion of the missile into complete contact with the external surface of a submarine, in which position the missile is held by the magentic field from the magnetic device. When said contact position has been taken up, a main explosive charge in the missile is detonated, said main charge preferably being of directed type, towards the magnetic contact surface of the missile.

According to a second aspect of the invention, the explosive charge in the missile is arranged movable from a position located adjacent to the foremost portion of the missile to a location adjacent to the rear portion of the missile, the propellant charge being located in an intermediate position between the movable main charge and the magnetic device, arranged to cause the movement of the main charge and to move the magnetic contact surface into contact with the external surface of the submarine when exploded.

According to a third aspect of the invention, the main charge is arranged in a tubular housing, arranged to telescopically move away from the main casing of the projectile when the propellant charge is exploded, thereby locating the explosive charge at a distance from the external surface of the submarine which exceeds the original length of the missile, or the distance which can be achieved by a movement of the main explosive charge within the outside casing the the missile.

One embodiment of the invention will now be more particularly described, by way of example, with reference to the accompanying drawings, in which:

DETAILED DESCRIPTION OF THE INVENTION

The illustrated missile has a missile body 1 with a magnetic contact surface 2. After launch from a ship or an aircraft the missile is arranged to sink with its axis vertical and the surface 2 leading, as shown in FIG. 1(*a*). FIG. 1(*b*) shows how the missile is swung over, when an edge portion of the magnetic contact surface 2 takes up a contact with an inclined outer surface 3 of a submarine. This movement is caused mainly by torque from momentum, and to a small extent by torque from gravity and the magnetic field associated with the surface 2.

When the pre-orientation position of FIG. 1(*b*) is taken up, it is desirable to impose additional force so as to move the magnetic contact surface 2 into a position of complete contact with the outer surface 3. This is in order to prevent the missile from sliding past the submarine, and to orientate the missile in relation to the outer surface 3 in a manner facilitating the use of a directed explosive charge.

Figure 3:
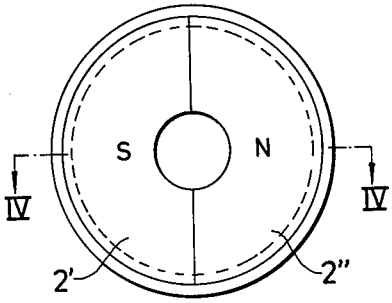
FIG. 3 is a plan view of the magnetic contact surface of the missile.
Figure 4:
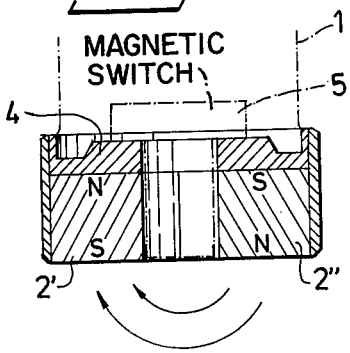
FIG. 4 is a cross-sectional view IV—IV of the magnetic contact surface shown in FIG. 3, and FIG. 5 schematically illustrates how a magnetically operated switching means of the missile is influenced when the missile contacts the external surface of a submarine.
Figure 5:
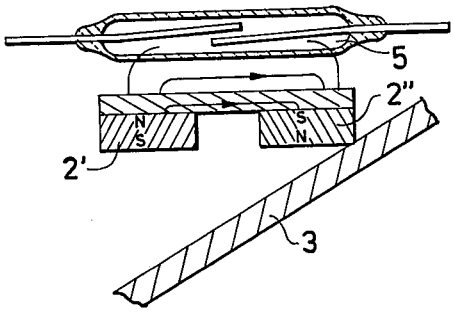

As shown in FIGS. 3 and 4, the magnetic contact surface 2 is provided by two semi-circular permanent magnets, 2', 2'', located in a reversed magnetic polarity relationship to each other, whereby a co-acting magnetic field is created. The surface of the magnets 2', 2'' remote from the contact surface 2 is in contact with a plate 4 joining the magnetic north and south poles. As shown in FIG. 5, a magnetically operated switching means 5 is arranged located above the plate 4.

When the magnetic surface 2 approaches a metal object having a certain mass, the magnetic leakage field above the plate 4 is influenced, that is, it is increased. As a result, the magnetic switching means is operated.

Referring now to FIG. 1(*c*), the missile body 1 takes up contact with the outer surface 3 as previously discussed, and is swung over to the position shown, mainly by torque from momentum. In this position, the magnetic leakage field above the plate 4 is increased, and as a result, the magnetic switching means 5 is operated from the open position shown to a closed position. This operation is used to trigger a small propellant charge 6 located adjacent to the switching means 5, and the explosion causes a force to be imposed on the foremost portion of the missile, which is swung over into complete contact with the outer surface 3 of the submarine. The explosion also causes a main explosive charge 7, which is of the directed type and located in a tubular housing 8, to move telescopically away from the missile body 1 and the outer surface 3 of the submarine. An igniter 9 located adjacent to the end wall of the tubular housing 8 is attached by means of a wire 10 to the missile body, and when the tubular housing 8 has moved away from the missile body a distance predetermined by the length of the wire 10, that is, when the proper "stand-off" has been established, the main charge 7 is detonated. The position taken up when the main explosion takes place, is shown in FIG. 1(*d*). As shown, the main charge 7 is thus positioned at a distance from the outer surface 3 and directed towards same, so that the explosive energy imposed upon the submarine will be maximal, because of the "stand-off".

Figure 1A:
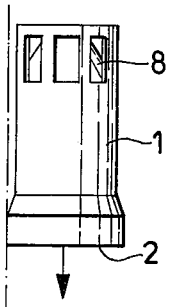
FIGS. 1(*a*) to (*d*) are side views of a missile embodying the present invention shown respectively in four successive stages after launch, namely, free travel, first contact of an edge portion against the external surface of a submarine, action to force the missile into complete contact with the external surface, and movement of a main, directed, explosive charge away from the external surface.
Figure 1B:
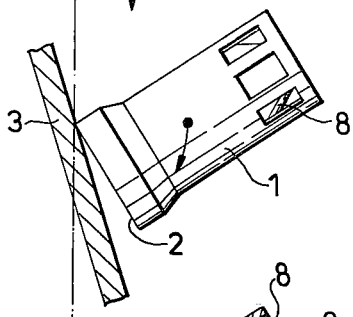
Figure 1C:
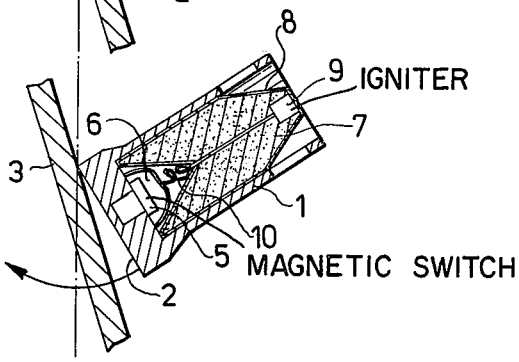
Figure 1D:
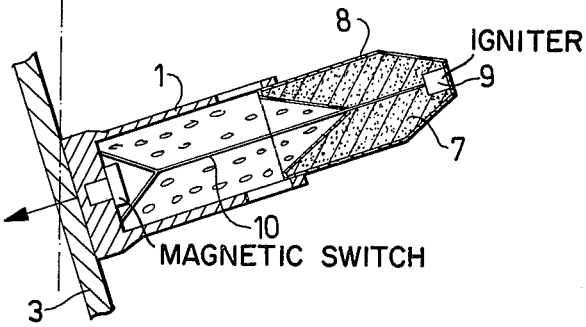
Figure 2:
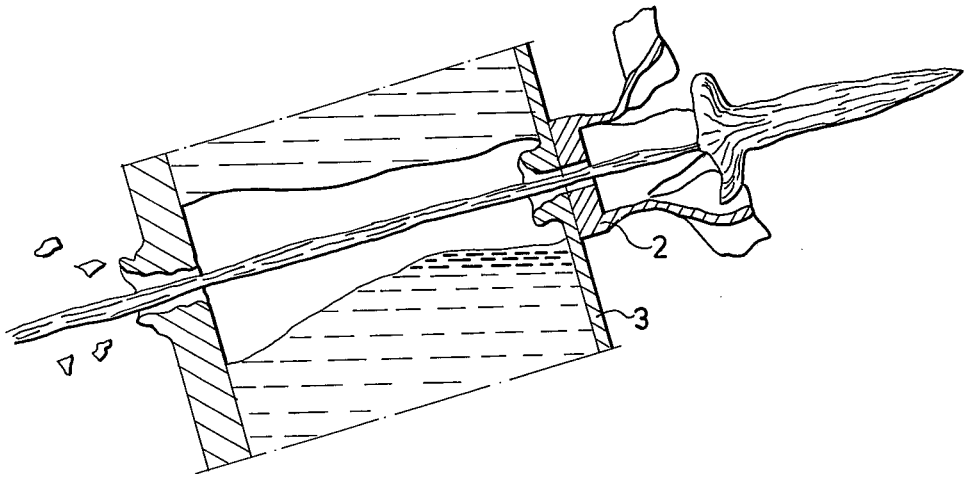
FIG. 2 is a cross-sectional view showing how the directed explosive charge penetrates the outside and inside wall surfaces of the submarine.

The penetrating action of the missile, when the main charge 7 is exploded, is illustrated in FIG. 2. Due to the fact that the charge 7 is a shaped or hollow charge aligned perpendicularly to the outer surface 3 and located at a certain distance from same (the "stand-off"), the penetrating effect is maximised. In spite of this, the length of the missile is kept to a minimum during the critical pre-orientation stage, that is, until the heavy "recoil torque" due to the small propellant charge 6 is established.

The missile described above is only an example of how the invention can be embodied, as many modifications are possible. Thus, missiles embodying the invention may be arranged with the main explosive charge 7 movable within the missile body 1, that is, without the tubular housing 8 telescopically extendable from the missile body 1. The main explosive charge 7 may instead be arranged to be non-movable with respect to the missile body 1. The small propellant charge 6, used to align the magnetic contact surface 2 into a fully contacting position with the outer surface 3 of a submarine, can also be located in other positions than shown, for example, adjacent to the rear end of the missile body 1, if the object of this charge 6 is only to cause complete adherence against the outer surface. Furthermore, the main explosive charge 7 may be ignited in other ways than as shown, for example by electrical ignition or any other suitable method. The magnets 2', 2'' have been referred to as magnets of permanent type, but other types of magnets such as electromagnets may be used.

The magnetic switching means 5 may also be located in any other relationship to the magnets 2', 2'', in which the magnetic leakage field is influenced by a metal mass located nearby the magnets 2', 2''. The magnetic switching means 5 is also preferably arranged to be rotatable in relation to the direction of the magnetic field, whereby the sensitivity of the switching means 5 can be preset by orientation in a different angular relationship to the magnetic field.

The missile according to the present invention may be further modified, in order to secure adherence against the external surface of a submarine, and this modification may be of particular importance when the missile is used against a submerged submarine, travelling at a relatively high speed. By introducing a small rocket propulsion charge in the missile, having at least one exhaust nozzle for the combustion gases, directing the gas jet(s) away from the magnets 2', 2''. When the missile takes up a position in which the magnetic switching means 5 is operated, the rocket propulsion charge is ignited. The resulting rocket propulsion force is thus used as an additional force, acting to force the missile into complete adherence with the external surface of the submarine, and the time necessary for taking up this position is thus reduced.

Since the rocket porpulsion force is only used as an additional force, intended to orientate the missile in a position of complete adherence from a first contact position, the rocket propulsion charge can be very small, having an extremely short combustion time, typically less than 0.1 second.

Finally, if the above modification is utilized, the missile may also include a directed charge, which is not orientated at a distance from the external surface of the submarine by means of a propellant charge when exploded, but preorientated in the missile body 1 at a fixed distance from the contact surface.

I claim:

1. An underwater missile for use against submerged submarines, the missile comprising a missile housing having at a foremost end portion thereof, which is intended to contact a submerged submarine, a magnetic contact surface provided by two magnets located adjacent to each other in reversed magnetic polarity relation creating a field of magnetic leakage, and a magnetically operated switching means located adjacent to the magnetic leakage field from the magnets and arranged to be operated when the leakage field is increased because of a metallic object located within the magnetic field of the magnets, the operation of the switching means being arranged to trigger an explosive charge within the missile.

2. An underwater missile according to claim 1, in which the operation of the switching means is utilized to detonate a small propellant charge, arranged to impose a force directed to cause complete adherence between the magnetic contact surface of the missile and the outer surface of a contacted submarine, before detonating a main explosive charge, intended to penetrate the submarine.

3. An underwater missile according to claim 2, in which the small propellant charge is located in an intermediate position between the magnetic contact surface and the main charge, and that the explosion of the smaller charge is arranged to move the main charge into a position located further away from the magnetic contact surface.

4. An underwater missile as in claim 3, in which the main charge is located in a tubular housing, telescopically movable in relation to the missile housing, arranged to move in direction from the magnetic contact surface when the smaller charge is exploded.

5. An underwater missile as in claim 4, in which an igniter for the main charge is located adjacent to the end portion of the charge directed away from the magnetic contact surface, mechanically connected with the missile body and triggered when the main charge with igniter has moved a predetermined distance from the magnetic contact surface.

6. An underwater missile as in claim 5, in which a metal plate is arranged in an intermediate position between the magnetic poles directed from the magnetic contact surface and the magnetically operated switching means, arranged to connect said magnetic poles and thus reduce the magnetic field influencing the switching means.

7. An underwater missile as in claim 6, in which the magnetically operated switching means is arranged to faciliate adjustment into desired angular relationship to the magnetic field, in order to adjust the operational sensitivity of the switching means.

8. An underwater missile as in claim 7, in which the main explosive charge is a charge having directed penetration properties.

9. An underwater missile as in any one of claims 1 to 8, in which the magnetic field is provided by permanent magnets.

* * * * *